US005516098A

United States Patent [19]

Aiello

[11] Patent Number: 5,516,098

[45] Date of Patent: May 14, 1996

[54] SPORT BALL FOR ROLLER HOCKEY

[75] Inventor: Jeffrey A. Aiello, 718 Bradley St., Matteson, Ill. 60443

[73] Assignee: Jeffrey A. Aiello, Matteson, Ill.

[21] Appl. No.: 292,103

[22] Filed: Aug. 17, 1994

[51] Int. Cl.[6] ..... A63B 69/00

[52] U.S. Cl. ..... 273/57.2; 273/58 H; 273/58 F; 273/58 R

[58] Field of Search ..... 273/231, 58 H, 273/58 R, 57, 58 B, 58 BA, 128, 56

[56] References Cited

U.S. PATENT DOCUMENTS 2,670,206 2/1954 Brewster ..... 273/58 H
4,448,418 5/1984 McNeill .
4,872,676 10/1989 Townsend .
4,917,381 4/1990 Spector .

FOREIGN PATENT DOCUMENTS 1615838 5/1971 Germany .

*Primary Examiner*—V. Millia
*Assistant Examiner*—C. Anderson
*Attorney, Agent, or Firm*—Hill, Steadman & Simpson

[57] ABSTRACT

A sport ball for use as a puck in roller hockey or street hockey has a substantially smooth spherical outer surface and a substantially smooth inner surface. The hollow interior is filled to 10 to 25% with a liquid, such as water.

3 Claims, 1 Drawing Sheet

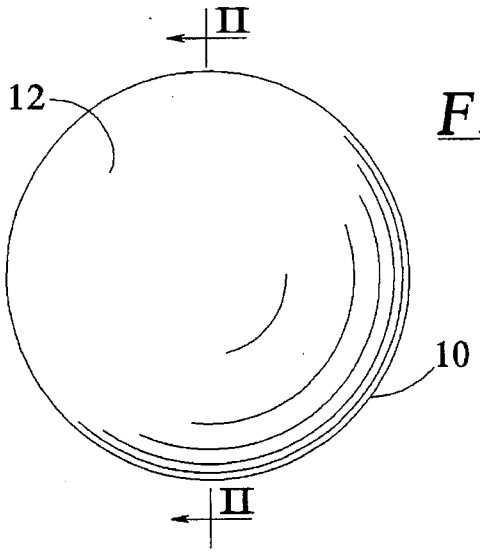
FIG. 1
FIG. 2
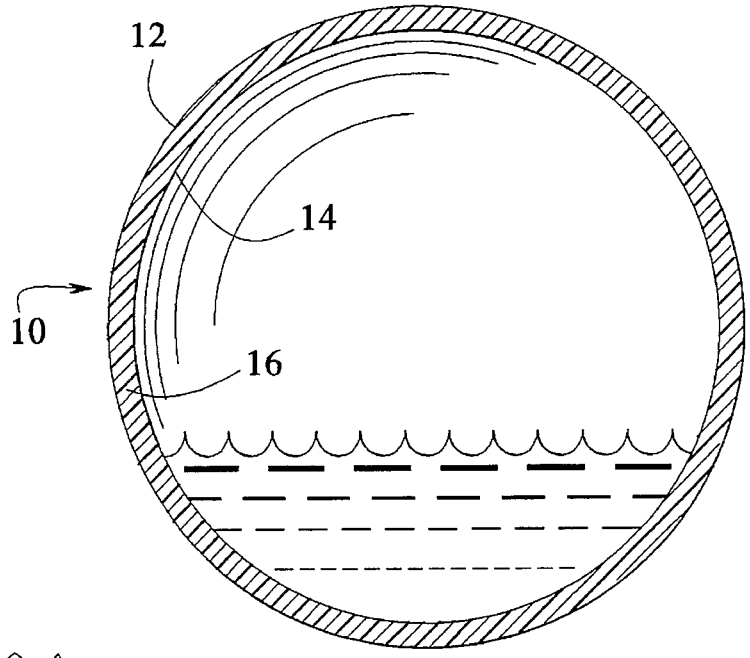
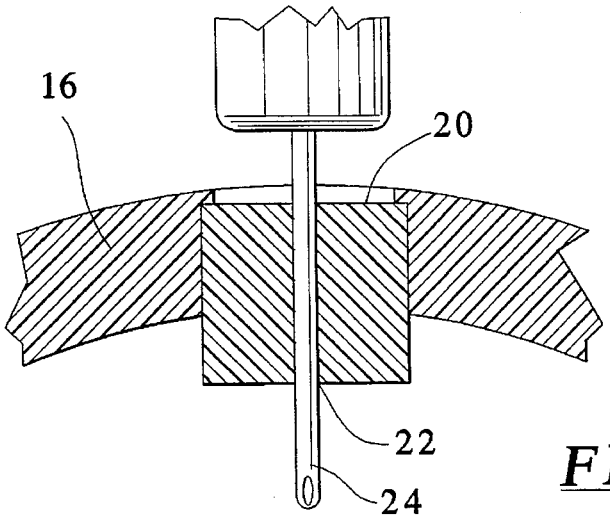
FIG. 3

SPORT BALL FOR ROLLER HOCKEY

BACKGROUND OF THE INVENTION

1. Field of the Invention

The present invention relates generally to a sport ball, and more particularly to a sport ball for use in roller hockey or street hockey.

2. Description of the Related Art

The sport of roller hockey has grown considerably in recent years. Instead of being played on ice, roller hockey is played on a dry surface by players wearing roller skates. With the development and increase in popularity of in-line skates, roller hockey may now be played with the speed and excitement of ice hockey.

In-line skates permit roller hockey to be played not only on smooth indoor surfaces, but also enable roller hockey to be played outdoors on parking lots, basketball courts, streets, and other concrete or asphalt surfaces, thus giving rise to the term street hockey for this sport. The surfaces on which street hockey, or roller hockey, is played are not particularly smooth, typically having bumps and pits, and often having gravel and other debris scattered across the playing area. The irregular surfaces cause the puck to bounce and move erratically during play.

The puck used in roller hockey may be of a thickened disk shape such as commonly used for ice hockey, although usually of a different material and weight. To achieve gliding of the puck over the playing surface, it has been proposed to mount a number of spheres in the puck which extend out of the upper and lower surfaces of the puck and on which the puck rests for rolling movement. More commonly, however, the disk shaped puck is replaced by a ball in street hockey or roller hockey. When a ball is used as the puck on an irregular surface, the ball has a tendency to bounce, both as it moves across the playing surface and while it is being moved, or handled, by a player using a hockey stick. The light weight of a hollow ball results in wind having an effect on puck movement. Attempts to address this problem have resulted in different street hockey balls being made available with different densities and textures for different playing surfaces. Different balls are also produced for play in different temperatures.

SUMMARY OF THE INVENTION

An object of the present invention is to substantially eliminate bouncing of sport balls used as pucks in roller hockey.

Another object of the invention is to enable straight line passing, whether in the air or on the ground, in roller hockey with little or no effect from wind.

Yet another object of the invention is to encourage confident stick handling and passing by players of roller hockey.

A further object of the invention is to provide a roller hockey ball that is variable in weight and damping effect to accommodate different playing surfaces and playing conditions with a single ball.

These and other objects and advantages of the invention are provided in a sport ball for use as a puck in roller hockey, wherein the ball has a hollow interior containing a predetermined quantity of liquid. The liquid, which is preferably water, is within the preferably smooth interior surface of the ball to provide weight for added momentum to the puck during play; yet the water dampens any tendency to bouncing as the puck moves across a rough surface.

The quantity of liquid in the ball may be changed to accommodate different playing conditions. When play is on an asphalt surface such as a tennis court, parking lot, or on the street where the surface may be cracked or pitted, or where stones, twigs, leaves or other debris may be present, the quantity of water in the ball is increased. This also decreases the effect of wind on the movement of the ball. On the other hand, the quantity of liquid may be decreased when the ball is used indoors and/or on a smooth surface, such as a gymnasium floor or indoor roller rink.

BRIEF DESCRIPTION OF THE DRAWINGS

FIG. 1 is a side elevational view of a sport ball for use in roller 1 hockey according to the present invention;

FIG. 2 is a cross section of the sport ball of FIG. 1 along line II—II; and FIG. 3 is an enlarged cross section of one embodiment of a fill valve on the sport ball of the present invention.

DETAILED DESCRIPTION OF THE PREFERRED EMBODIMENTS

Referring first to FIG. 1, the sport ball 10 of the present invention is shown in side elevational view. It is spherical in shape and is of an elastomeric material. An outer surface 12 of the ball is preferably textured slightly. In one embodiment, the ball is approximately 2.6 inches (6.6 cm) in diameter and weighs approximately 2 ounces (56.7 g). Street hockey balls may be of different sizes and weights, however. For example, street hockey balls within a weight range of 45 to 90 grams may be provided.

In FIG. 2, the sport ball 10 of the present invention is shown in cross section. The outer surface 12 and a substantially smooth inner surface 14 define a wall thickness of a wall 16 of approximately 0.15 inches (0.38 cm). The elastomeric material of the wall 16 is flexible and durable and may be any of the known materials from which street hockey balls are made.

A liquid 18 is inside the hollow interior of the ball 10. The liquid is preferably water, although other liquids may be used as well. It is important that the quantity of liquid 18 in the ball 10 not fill the interior but be free to move about therewithin. Approximately 10 to 50% of the interior space of the ball 10 is filled with the liquid, depending on surface-and wind conditions. During testing with one ball having of a fixed size and shell material, it has been found that a range of 14 to 22% of the interior volume is to be occupied by water for the best results. In other words, the exemplary ball contains between 15 to 25 cc of water within a ball of approximately 101.8 cc interior volume.

In other street hockey balls, more or less liquid may be used. Generally, it has been found that less than 10 grams of water in the present ball results in the ball having excessive bounce so that the beneficial effect of the invention is not present. On the other hand, including more than 25 grams of water yields a ball that is too heavy. As indicated above, a total weight of the ball should be in the range of 45 to 90 grams, with 55 to 80 grams being a preferred range.

The interior surface 14 of the ball 10 is generally smooth to permit the water or other liquid 18 to flow about unrestricted in the interior. Thus, during slow rotation of the ball 10, the liquid flows on the interior surface 14. During fast rotation of the ball 10, such as during spirited play, the liquid will tend to adhere to the inner surface 14. This enables the ball to behave much like a high density ice hockey puck during passing as it is rolling quickly over the surface. But when stopped, such as by a hockey stick, the liquid moves to one side of the ball to stabilize the ball 10 and prevent it from bouncing away from the hockey stick as a hollow, air-filled ball would tend to do. The movement of the ball may be more easily controlled so that handling of the "puck" with the hockey stick may be performed with more confidence. The weight of the liquid 18 in the ball 10 increases the momentum of the ball 10 during movement, such as during passing, whether the pass is on the ground or in the air. This greater weight lessens the effects of wind on the ball movement, as well. When the ball strikes debris or surface irregularities, the damping effect of the liquid on the movement prevents bouncing and misdirection of the ball.

The present street hockey ball 10 may be provided with a fixed quantity of liquid in the interior cavity. Accordingly, different balls may be made available for different playing conditions. For instance, a ball 10 with 15 cc of water in the interior cavity is provided for interior play on smooth surfaces, such as gymnasium floors or skating rinks. A ball 10 with 20 to 25 cc of water is provided for outdoor play on the street. The greater quantity of water decreases the tendency to bounce and decreases the effect of wind.

Alternately, one ball may be provided that has means for varying the quantity of liquid within the ball. For example, a valve 20 shown in FIG. 3 in a wall 16 of the present sport ball is of flexible material that has an opening 22 through which a filler needle 24 may be inserted. By attaching the filler needle to a supply of liquid, more liquid may be inserted into the interior cavity of the ball 10. Similarly, by applying a low pressure to the filler needle 24, the quantity of liquid in the interior may be decreased. Preferably, the filler needle is connected to a syringe-type device for inserting and removing liquid from the ball. A syringe-type device having markings for determining the quantity of liquid inserted or removed is preferred.

The valve 20 recloses after withdrawal of the needle 24 to seal the ball 10 and prevent leakage. The needle 24 may be reinserted to change the quantity of water in the ball as desired.

Thus, there is shown and described a street hockey puck or ball that overcomes the disadvantages of the known such pucks or balls and enables play to proceed on irregular surfaces with little bouncing, little effect of wind, and straighter passing.

Although other modifications and changes may be suggested by those skilled in the art, it is the intention of the inventors to embody within the patent warranted hereon all changes and modifications as reasonably and properly come within the scope of their contribution to the art.

I claim:

1. A sport ball for roller or street hockey comprising:

a hollow spherical body adapted to withstand impacts and made of a dense elastomeric material having a substantially smooth outer surface and a substantially smooth inner surface, said substantially smooth inner surface defining a predetermined inside volume free of solid particles; and means for inhibiting bouncing of said hollow spherical body as said body rolls on rough surfaces, including a predetermined quantity of water in said predetermined inside volume sufficient to occupy between approximately 10 to 22% of said predetermined inside volume, wherein said ball is approximately 2.6 inches in diameter and has a wall thickness of approximately 0.15 inches.

2. A street hockey ball as claimed in claim 1, wherein a total weight of said hollow spherical body and said predetermined quantity of liquid is in a range of 45 to 90 grams.

3. A street hockey ball as claimed in claim 2, wherein said total weight is in a range of 55 to 85 grams.

* * * * *